United States Patent [19]

Withers, Jr. et al.

[11] 4,385,453

[45] May 31, 1983

[54] END PANEL INSULATOR ASSEMBLY FOR TEMPERATURE CONTROLLED ROTARY CYLINDER

[75] Inventors: L. Andrew Withers, Jr., 5801 Whispering Pines Cir., Mableton, Ga. 30059; Leland A. Withers, Sr., 1706 Greenbrook Dr., SW., Austell, Ga. 30001; Jean D. Withers, Auburn; Carlo Fineo, Austell, both of Ga.

[73] Assignees: Leland A. Withers, Sr.; L. Andrew Withers, Jr., both of Austell, Ga.

[21] Appl. No.: 258,324

[22] Filed: Apr. 28, 1981

[51] Int. Cl.[3] ..... F26B 13/08; F26B 25/20

[52] U.S. Cl. ..... 34/110; 34/124; 165/89

[58] Field of Search ..... 34/110, 119, 124; 29/110, 118, 119; 100/93 RP; 162/375, 378, 379, 207; 165/89, 146, 185; 219/10.49 A, 469; 432/10, 60, 253, 255.1

[56] References Cited

U.S. PATENT DOCUMENTS

| | | | |
|---|---|---|---|
| Re. 25,927 | 6/1965 | Justus et al. | 165/1 |
| 1,076,330 | 5/1913 | Thompson | 34/110 |
| 1,640,855 | 7/1926 | Shlick | 34/110 |
| 2,047,372 | 6/1936 | Jalens | 34/48 |
| 2,074,455 | 1/1937 | Carleton | 34/4 |
| 2,413,567 | 2/1946 | Hornbostel | 34/124 |
| 2,571,426 | 5/1951 | Doniak | 219/19 |
| 2,591,307 | 6/1952 | Sibel | 263/33 |
| 4,241,518 | 7/1980 | Alexy | 34/110 |
| 4,321,759 | 3/1982 | Gamble | 34/110 |

*Primary Examiner*—Larry I. Schwartz
*Attorney, Agent, or Firm*—Thomas & Kennedy

[57] ABSTRACT

A lightweight plyable heat and noise end panel insulator panel is mounted to the exterior surface of the axial end wall of a temperature controlled cylinder. The insulator panel comprises multiple layers of heat and noise insulation material and relatively non-stretchable material stitched and grommeted together whereby a pattern of pockets are formed to hold the fragile heat insulation in place. The panel defines a central opening and a slot extending from the central opening through the outer peripheral edge portion so that the panel can be positioned about the axle of the cylinder.

27 Claims, 11 Drawing Figures

11
19
12
13
14
22
56
54
59
25
70
80
74
64
58
20
84
82
89
88
81
85
29
85
85
84
86
89
85
82
26
62
80
74
36
61
16
15

END PANEL INSULATOR ASSEMBLY FOR TEMPERATURE CONTROLLED ROTARY CYLINDER

BACKGROUND OF THE INVENTION

This invention relates to thermal and noise insulation of the axial end walls of heated or cooled temperature controlled cylinders, as for example the type of rotatable cylinders used in the paper manufacturing industry, wherein a web of paper material passes over the peripheral convex surface of a heated dryer cylinder and absorbs heat from the cylinder.

In the process of manufacturing paper products, wet paper is moved in a web across a plurality of heated cylinders, and the heated cylinders progressively dry the paper which eventually emerges as a dryer product. The dryer cylinders vary in length and in diameter, but a common range of lengths and diameters of dryer cylinders would be between 1 and 40 feet in length and between 1 and 30 feet in diameter. The normal rotational velocity of operating dryer cylinders is between 100 and 10,000 surface feet per minute, and a common temperature range for dryer cylinders would be between 100° F. and 600° F.

The dryer cylinders can be heated from various heat sources, with a common heat source being superheated steam at a temperature sufficient to heat the cylindrical convex surface of the dryer cylinder to the desired temperature. The steam is transmitted under pressure through the axles of the dryer cylinders to heat the inside of the dryer cylinders.

Since the web of paper makes continuing contact with the external convex surface of the dryer cylinder wall during the operation of the dryer cylinder, a major portion of the heat applied to the cylindrical wall of the dryer cylinder is absorbed by and taken away by the paper; however, the web of paper does not contact the axial end walls of the dryer cylinder, and the heat from inside the dryer cylinder that is transferred through the axial end walls is lost to the atmosphere.

Some attempts have been made to insulate the axial end walls of heated dryer cylinders. For example, U.S. Pat. No. 2,571,426 discloses the mounting of a heat insulating asbestos disc to the inner face of the axial end wall of a dryer cylinder, while U.S. Pat. No. 4,241,518 discloses clamping semi-circular panels to the connector bolts of the axial end walls of a dryer cylinder. While it appears that the attachment of insulation structures to the internal surfaces of the axial end walls of a dryer cylinder would function to retard the loss of heat from a dryer cylinder, it appears that such a structure would be difficult to install and would be hidden from inspection unless the manhole cover was removed from the dryer cylinder. While it appears that external heat shields could be applied to the external surfaces of an axial end wall of a rotatable dryer cylinder by attaching the heat shields to the bolts that attach the axial end wall to the cylindrical wall, it is undesirable to do so since the bolts must contain the axial end wall in position against the pressure of the high pressure superheated steam within the dryer cylinder and the loosening or otherwise adjusting of the bolts might result in a safety hazard due to the bolts parting from the dryer cylinder during rotation or due to steam leakage between the cylindrical wall and the axial end wall of the dryer cylinder. Additionally, many of the dryer cylinders which contain fluid under pressure are regulated by ASME pressure vessle codes which limit the use of the connector bolts for purposes other than connecting the end wall to the cylindrical wall of the assembly.

The use of nonflexible rigid insulator panels with the axial end walls of temperature controlled rotatable cylinders apparently requires the insulator panels to be constructed for a particular end wall shape so the nonflexible insulator panels in some instances would be usable for only one model dryer cylinder, and the rigid insulator panels apparently would require that the panels be formed in a multiple number of parts that would have to be assembled about the axle of the dryer cylinders when being applied to the axial end wall of the dryer cylinder in its plant operating configuration.

The usual construction of a heated dryer cylinder for use in a paper making process is to have the axial end wall formed in a precision fit with respect to the cylindrical wall of the dryer cylinder. The connector bolts can be tightened in a pattern to draw the axial end wall onto the cylindrical wall, and when the axial end wall is to be removed from the cylindrical wall, the connector bolts are loosened and threaded jack screw openings usually are present in the axial end wall so that externally threaded jack screws can be rotatably inserted into the jack screw openings to bear against the end of the cylindrical wall and progressively push the axial end wall off the cylindrical wall. When the axial end wall is properly mounted on the cylindrical wall and the dryer cylinder is ready for normal operation, the jack screws usually are removed from the jack screw openings of the axial end wall.

SUMMARY OF THE INVENTION

Briefly described, the present invention comprises a lightweight plyable end panel heat and noise insulator assembly for a paper machine dryer cylinder, or for a similar heated or cooled cylindrical structure, which includes an annular one-piece flexible insulation blanket that defines a central opening and an approximately circular outer periphery and a split or slot extending from the inner opening to the outer periphery, whereby the insulator blanket can be positioned about the axle of a rotatable dryer cylinder and positioned in abutment with the axial end wall of the dryer cylinder when the cylinder is in its plant operating configuration. In one embodiment inner and outer mounting rings are rigidly connected to the inner and outer portions of the axial end wall of the dryer cylinder, and the annular blanket is connected at its inner and outer peripheries to the inner and outer mounting rings. In other embodiments the blanket can be mounted to the axial end wall by adhesive, by the use of a combination of an inner or an outer mounting ring with radially extending stays, and/or with adhesive.

The insulation blanket is fabricated from one or more layers of heat insulation material, such as rockwool or fiberglass, and the blanket includes an outer durable, substantially heat resistent cover, such as woven Nylon sheet material coated with Neoprene, or Nomex, Teflon, Kevlar or Viton sheet material. Additionally, one or more layers of relatively unstretchable material can be included among the layers of heat insulation and heat resistent materials, with the relatively unstretchable material being, for example, wire screen or woven sheets of Nomex, Kevlar Viton yarns. The multiple layers of the insulator blanket are connected to each other by stitching extending through the layers of blanket material and by grommets, and the stitching is arranged to form pockets in the blankets, as for example in approximately concentric annular patterns about the central opening of the insulator blanket with the annular patterns including both annular stitching and radial stitching to form a quilted arrangement of pockets. The pockets tend to hold the insulator material in place, and this prevents the insulator material from acumulating in some areas and leaving a void in other areas and retards the breakdown of the fibers of the insulator material.

In the embodiment that includes inner and outer mounting rings, the outer mounting ring of the end panel insulator assembly is rigidly connected to the axial end wall of the dryer cylinder by means of mounting screws connected to the outer mounting ring and threadably engaging the threads of the jack screw openings or other threaded openings of the axial end wall of the dryer cylinder. The inner mounting ring is clamped to the central protrusion of the dryer cylinder, and the outer and inner peripheral portions of the dryer blanket each include a series of grommets or similar openings which normally overlie the outer and inner mounting rings, and connectors connect the grommets to the mounting rings. Flexible stays can be included so as to extend radially from the central opening of the blanket outwardly to the outer peripheral edge portion, with grommets formed through the ends of the stays and the material of the insulator blanket. Also, the blanket can be applied directly to the exterior surface of the axial end wall with adhesive, if desired. The adhesive connection of the insulator blanket can be used alone or in combination with the other blanket connection features, as might be suitable for a particular cylinder structure.

Thus, it is an object of this invention to provide a flexible lightweight, durable end panel insulator assembly for mounting to the exterior surface of the axial end wall of a temperature controlled cylinder such as a heated dryer cylinder for a paper making process without using the connector bolts extending from the axial end wall to the cylindrical wall of the cylinder.

Another object of this invention is to provide an end panel insulator assembly for a temperature controlled cylinder which includes a replaceable insulator blanket fabricated in one piece and which is fabricated of flexible material, which is lightweight and which can be expediently installed and removed.

Another object of this invention is to provide an end panel insulator assembly for mounting to the exterior surface of the axial end wall of a temperature controlled cylinder which, when rotated, is safe in operation and which is effective to retard the transfer of heat through the cylinder end walls.

Another object of this invention is to provide an end panel insulator assembly for a temperature controlled cylinder, which is adaptable to various axial end wall contours, such as concave or convex end walls due to its flexibility.

Other objects, features and advantages of the present invention will become apparent upon reading the following specification, when taken in conjunction with accompanying drawings.

DETAILED DESCRIPTION

Figure 1:
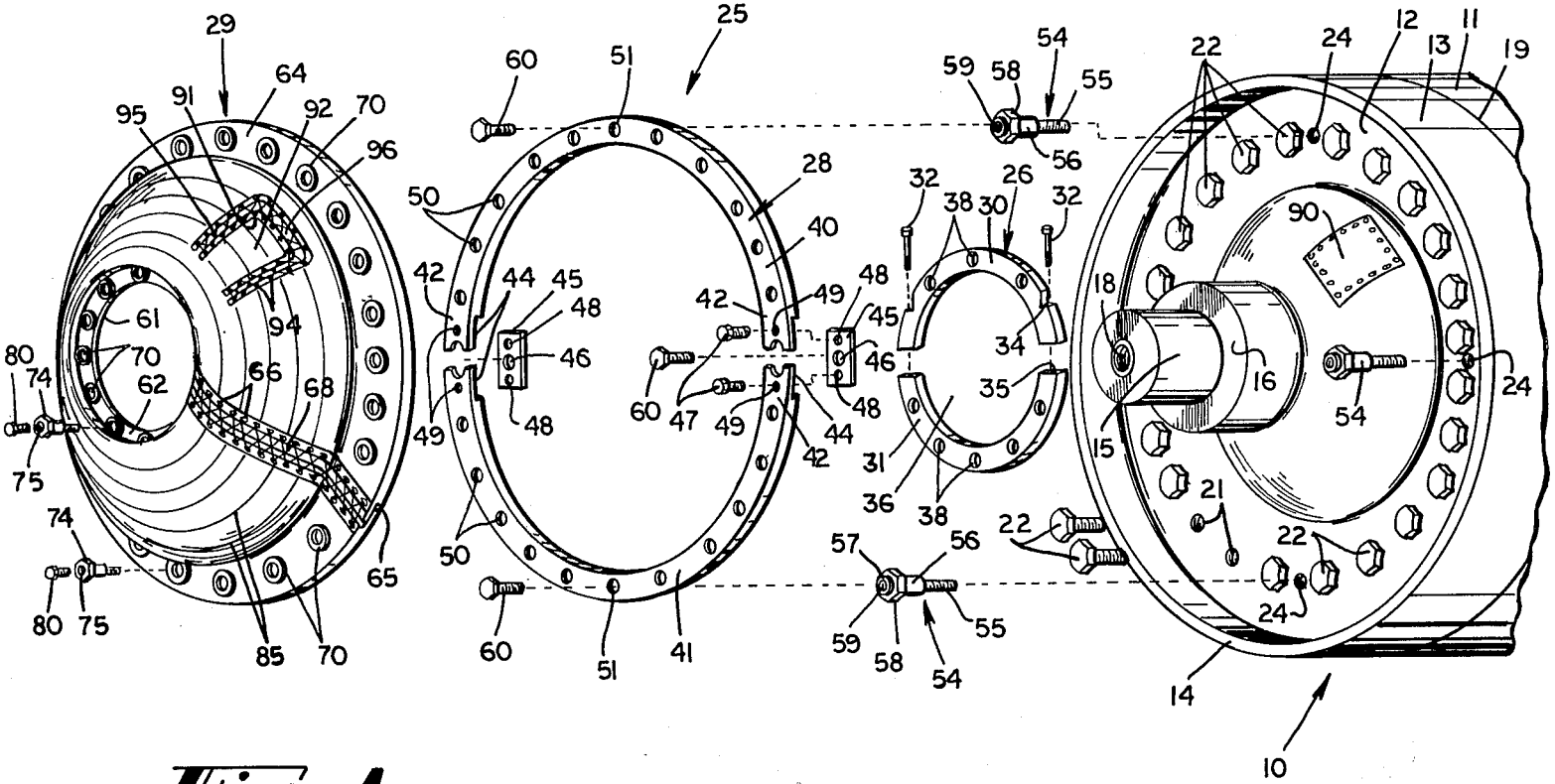
FIG. 1 is a perspective illustration of an axial end wall and a portion of a cylindrical wall of a dryer cylinder, and shows the end panel insulator assembly exploded away from the dryer cylinder.

Referring now in more detail to the drawings, in which like numerals indicate like parts throughout the several views, FIG. 1 illustrates a rotatable heated dryer cylinder 10 which includes a convex outer cylindrical wall 11 and axial end walls 12 (only one shown) which close the ends of the cylindrical wall 11. Typically, one axial end wall 12 of the dryer cylinder will include an annular surface 13 which is coextensive with the outer convex surface of cylindrical wall 11 that extends as a flange or rim 14 and the axial end wall 12 is recessed within the rim. The other end of the dryer cylinder may be structured differently, without the overhanging rim. An axle 15 extends centrally from the end wall 12, from protrusion 16 of the end wall, and the dryer cylinder is mounted at opposite ends on axles 15. The axles 15 include openings 18 extending therethrough, and steam communicates with the inside of the dryer cylinder 10 through the openings 18 in the axles 15.

The axial end wall 12 is rigidly connected to the cylindrical wall 11 by the axial end wall 12 bearing against the end annular edge 19 (FIG. 2) of the cylindrical wall 11. An internal protrusion 20 formed on the axial end wall 12 fits within the confines of the end annular edge 19 of the cylindrical wall 11, and threaded bores (not shown) are formed in the end annular edge 19 of the cylindrical wall 11. Holes 21 (FIG. 1) are formed in axial end wall 12 and the holes 21 are spaced and sized so as to register with the threaded bores. Screws 22 extend through the holes 21 and are threaded into the bores of the cylindrical wall so as to rigidly connect the axial end wall 12 to the cylindrical wall 11 in a tight fit.

Jack screw openings 24 usually are located at 90° intervals about axial end wall 12 between the screws 22. When the axial end wall 12 is to be removed from the cylindrical wall 11, the screws 22 are first removed from the structure, and then jack screws (not shown) are threaded into the jack screw openings 24, and when the jack screws engage the end annular edge 19 of the cylindrical wall 11, the jack screws push the axial end wall 12 away from the cylindrical wall 11. When the dryer cylinder 10 is completely assembled and ready for operation, the jack screws are removed from the jack screw openings. This is conventional in the art.

In the embodiment of the invention illustrated in FIGS. 1–6, end panel insulator assembly 25 is mounted to the axial end wall 12 of the dryer cylinder 10, and the end panel insulator assembly includes inner mounting ring assembly 26, outer mounting ring assembly 28, and annular insulator panel or blanket 29.

Inner mounting ring 26 comprises a pair of half rings 30 and 31 that are to be assembled in a circular configuration by placing their end portions in abutment with each other. Connector screws 32 extend through openings 34 and 35 adjacent the ends of the half rings, with opening 35 including threads for engagement with the threads of the screw 32. The screws 32 draw the half rings together in a clamped relationship. The opening 36 formed by the two half rings 30 and 31 is slightly smaller than the external annular dimensions of the protrusion 16 of axial end wall 12, so that when inner mounting ring assembly 26 is loosely placed about protrusion 16 and its screws 32 rotated to draw the half rings 30 and 31 together, a tight friction fit is formed by the inner mounting ring assembly 26 against the protrusion 16 of the axial end wall 12. A plurality of internally threaded connector openings 38 are formed in the inner mounting ring assembly 26.

Outer mounting ring assembly 28 includes a pair of half rings 40 and 41 which are normally arranged as indicated to form a circular shape. The end portions 42 of each half ring 40, 41 is undercut at 44 and support blocks 45 are sized and shaped to fit in the undercut portions 44. Support blocks 45 each include a centrally positioned unthreaded standoff hole 46, and a pair of internally threaded connector holes 48 positioned on opposite sides of the standoff hole 46. Unthreaded connector holes 49 also extend through the end portions 42 of the half rings 40 and 41, and screws 47 are inserted through the unthreaded connector holes 49 and into the internally threaded connector holes 48, thus connecting the support blocks 45 to the ends of the half rings 40 and 41 and rigidly connecting the half rings together to form the complete outer mounting ring assembly.

The half rings 40 and 41 of the outer mounting ring assembly 28 includes a series of equally spaced mounting holes 50. Also, standoff holes 51 are located intermediate the ends of the half rings 40 and 41. The standoff holes 51 are located across from each other in the outer mounting ring assembly 28 while the standoff holes 46 of the support blocks 45 are located across from each other in the ring assembly, with the standoff holes 46 and 51 being located usually at 90° intervals about the outer mounting ring assembly 28.

Figure 4:
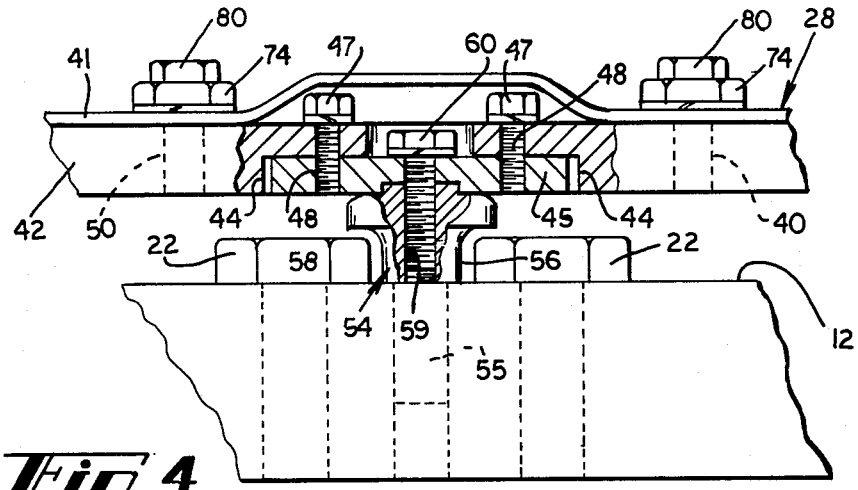
FIG. 4 is a detail illustration similar to FIG. 3, of the mounting ring and standoff bolt structure, at a location on the mounting ring where the mounting ring halves are joined.
Figure 5:
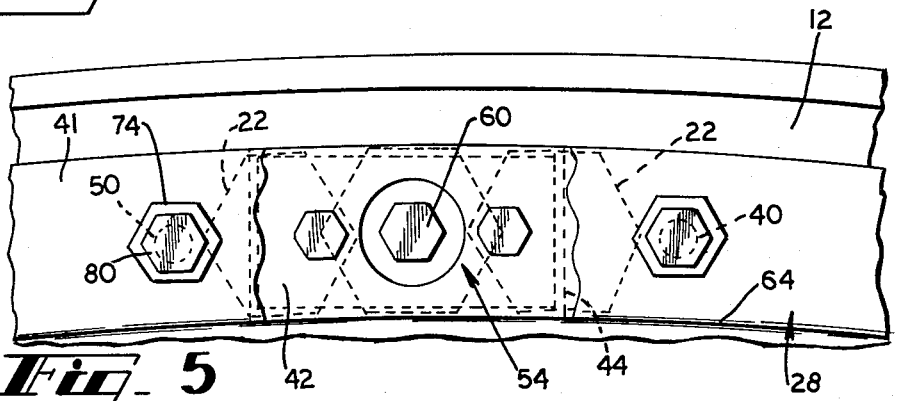
FIG. 5 is an end view of the mounting ring of FIG. 4.
Figure 3:
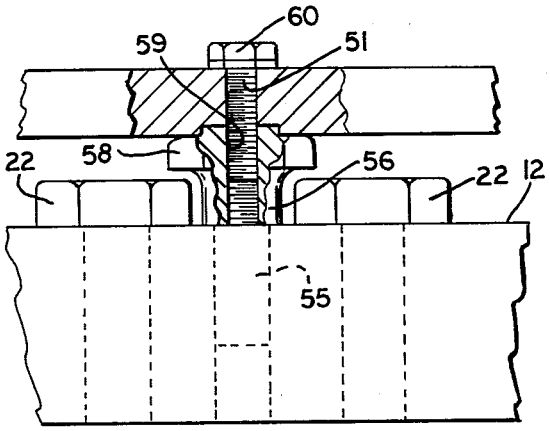
FIG. 3 is a detail illustration of the outer mounting ring and the standoff bolt structure at a position on the mounting ring where the mounting ring is not split.
Figure 6:
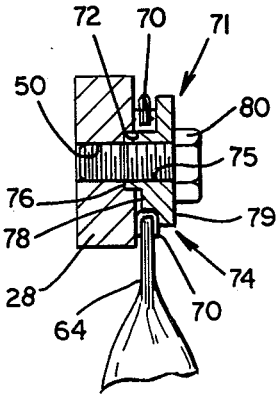
FIG. 6 is a side cross-sectional view of a cam connector and of a grommet, showing how the outer peripheral portion of the insulator panel can be connected to the outer mounting ring.

The outer mounting ring assembly 28 is sized and shaped to span the jack screw openings 24 of the axial end wall 12 of the dryer cylinder 10, and the standoff holes 46 and 51 of the outer mounting ring assembly 28 are alignable with the jack screw openings 24. Standoff studs 54 each includes a shank that includes a threaded portion 55 at its distal end, and intermediate enlarged boss 56, and hexagonal head 58. A pilot extension 57 is centrally located on the exterior surface of hex head 58, and an internally threaded bore 59 extends inwardly from the pilot extension of hex head 58. Each standoff stud 54 is arranged to be threaded into a jack screw opening 24, with the boss 56 limiting the penetration of the stud in the jack screw opening. This locates the threaded bore 59 of each standoff stud 54 at 90° intervals about the axial end wall 12 of the dryer cylinder, and the standoff holes 46 and 51 of the outer mounting ring assembly 28 are alignable with the threaded bores 59 of the standoff studs 54. Connector screws 60 extend through the unthreaded standoff holes 46 and 51 and are threaded into the bores 59 of the standoff studs 54, thus mounting the outer mounting ring assembly 28 to the axial end wall 12 of the dryer cylinder 10. Since the standoff studs 54 have their heads 58 displaced from the axial end wall 12 of the dryer cylinder, the outer mounting ring assembly 28 also is displaced from the surface of the axial end wall 12, at a position juxtaposed the screws 22 that connect the axial end wall 12 to the cylindrical wall 11 (FIGS. 3 and 4).

Insulator panel 29 is annular shaped and defines central opening 61 and includes an inner peripheral portion 62 and an outer peripheral portion 64. A slit or slot 65 is formed in insulator panel 29 and extends from the central opening 61 through the outer peripheral portion 64. Grommets 66 are positioned on opposite sides of the slot 65 and extend through the material of the insulator panel 29, and cords 68 are extended through the grommets 66 in a conventional manner to hold the slot in a closed configuration. The edge portions of the insulator panel about slot 65 are shaped so as to overlap when the slot is drawn closed by the cords 68. Thus, the grommets 66 and cords 68 function as a means for closing the slot 65.

The inner and outer peripheral portions 62 and 64 of insulator panel 29 include a series of grommets 70 that are spaced apart a distance corresponding to the spacing of the mounting holes 50 of outer mounting ring assembly 28 and the mounting holes 38 of the inner mounting ring assembly 26. Cam connectors 71 (FIG. 6) extend through the grommets 70 and into the mounting holes 38 and 50 of the inner and outer mounting ring assemblies 26 and 28. The mounting holes of both the inner and outer mounting ring assemblies 26 and 28 are counter bored, as illustrated at 72 of FIG. 6, with the mounting holes being internally threaded. Eccentric bushing 74 includes axial central opening 75 that extends therethrough and boss 76 that is sized and shaped to be received in the counter bore 72 of each mounting hole 38, 50. Eccentric cam 78 is formed adjacent boss 76 and is sized and shaped to fit within the opening of the grommet 70, and head 79 extends beyond the overhangs eccentric cam 78. Screw 80 extends through central opening 75 of eccentric bushing 74 and is threaded into the mounting holes 38, 50. When screw 80 is loosely connected to the mounting holes 38, 50, its eccentric bushing 74 can be rotated and its cam 78 will cause relative movement between its grommet 70 and the mounting holes 38, 50, so as to shift the positions of the peripheral portions 62, 64 of the insulator panel 29. This permits the installer to adjust the positions of the grommets, in order to accommodate slight misalignments of the grommets with the mounting holes, and to tighten the insulator panel.

Figure 2:
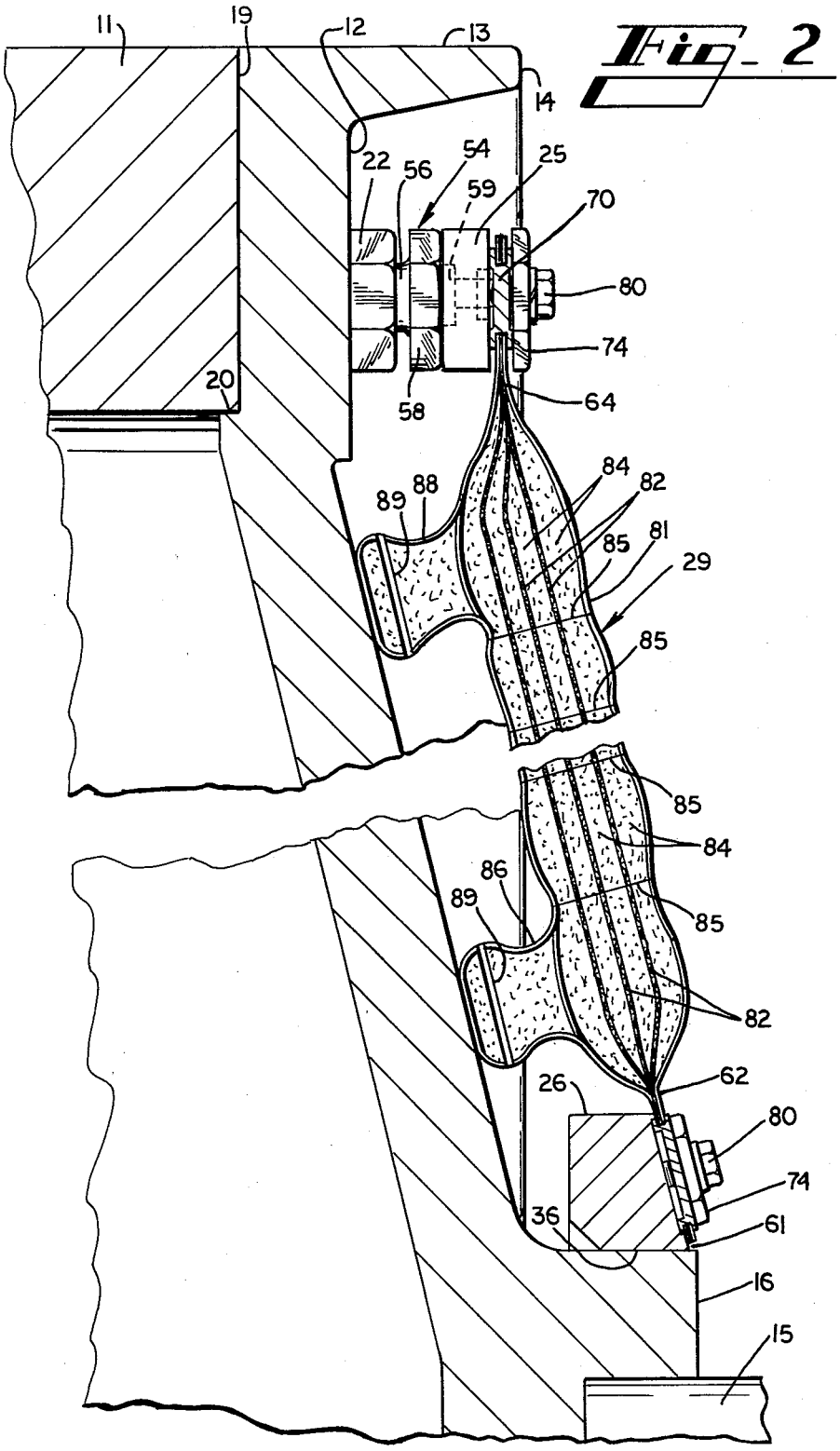
FIG. 2 is a side elevational view of one-half of the end panel insulator assembly and the axial end wall of a dryer cylinder.

As illustrated in FIG. 2, the insulator panel 29 comprises an outer covering 81 formed from a heat and water-resistent material such as a Nylon sheet coated with Neoprene, Teflon, or Hyperlon and an inner filler material 84 of a heat insulating substance, such as fiberglass, rockwool or foam insulator panels. The heat insulation material 84 is formed in layers, and relatively unstretchable material 82, such as wire screen or woven Nomex, is positioned between the insulation layers. Preferably the strands of the sheets of relatively unstretchable material are not oriented parallel to the strands of adjacent sheets of unstretchable material so that any weakness of one sheet in a bias direction of its strands is compensated for by another sheet. Both the insulation layers and unstretchable layers extend from the inner peripheral portion 62 to the outer peripheral portion 64. Stitching 85 extends through the insulation panel 29 and connects together the layers of insulation material 84 and the intervening layers of relatively unstretchable material 82. The stitching 85 is formed in approximately concentric annular patterns and in radial patterns about the central opening of the insulator panel. The stitching 85 forms pockets that tend to retard any shifting of material.

A pair of concentric seals 86 and 88 are formed on the inner surface of the insulator panel 29. The inner concentric seal 86 is positioned closely adjacent the central opening 61 of the insulator panel 29 while the outer concentric seal 88 is positioned next adjacent the outer peripheral portion 64. The seals 86 and 88 are formed in the shape of annular ribs and each comprises inner heat insulation material such as fiberglass and outer heat resistant material such as Nomex. Vent openings 89 are formed through the seals 86 and 88, with the vent openings comprising tubes extending radially through the seals. The vent openings permit any moisture that may be trapped adjacent the exterior surface of the axial end wall 12 to escape.

The insulator panel 29 as described herein, is formed in one piece from relatively flexible material and functions as a insulator blanket to retard the escape of heat from the exterior surface of the axial end wall 12 of the dryer cylinder 10. The flexibility of the insulator panel permits the slot 65 to be opened so that the slot can be installed about the axle 15 of the dryer cylinder, and the slot can then be held closed by inserting the cords 68 through the grommets 66 on opposite sides of the slot.

One of the axial end walls 12 of the dryer cylinder 10 usually includes an access opening (not shown), and cover plate 90 is normally bolted over or otherwise secured over the access opening. In order that the access opening and cover 90 can be reached without removing the end panel insulator assembly 25 from the dryer cylinder 10, the slot 65 can be opened to reach the access opening, or in the alternative, an access opening 91 can be formed in the insulator panel 29 and a flap 92 extended over the opening 91. In this embodiment grommets 94 are located adjacent the edges of the flap 92 and adjacent the access opening 91 and cords 95 connect the grommets together to maintain the closure flap 92 in its closed configuration. It will be noted that the distal edge 96 of the closure flap 92 is located away from the central opening 61 of the insulator panel, so that centrifugal force applied to the closure flap 92 due to the rotation of the insulator panel 29 with the dryer cylinder 10 normally urges the closure flap toward its closed position.

Figure 7:
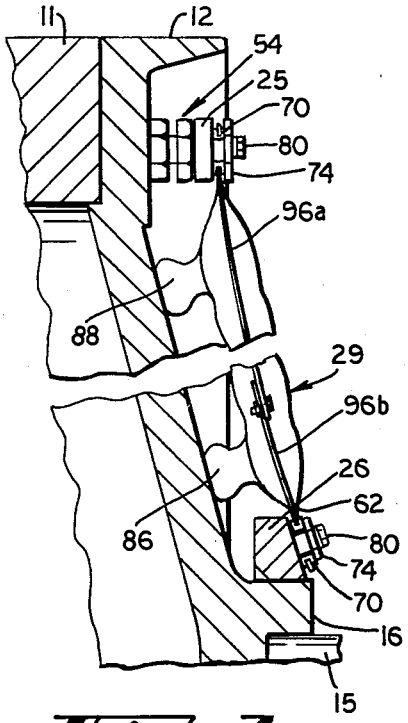
FIG. 7 is a side elevational view of one-half of the end panel insulator assembly, similar to FIG. 2, but illustrating an embodiment of the invention that includes internal rigidifying stays.
Figure 8:
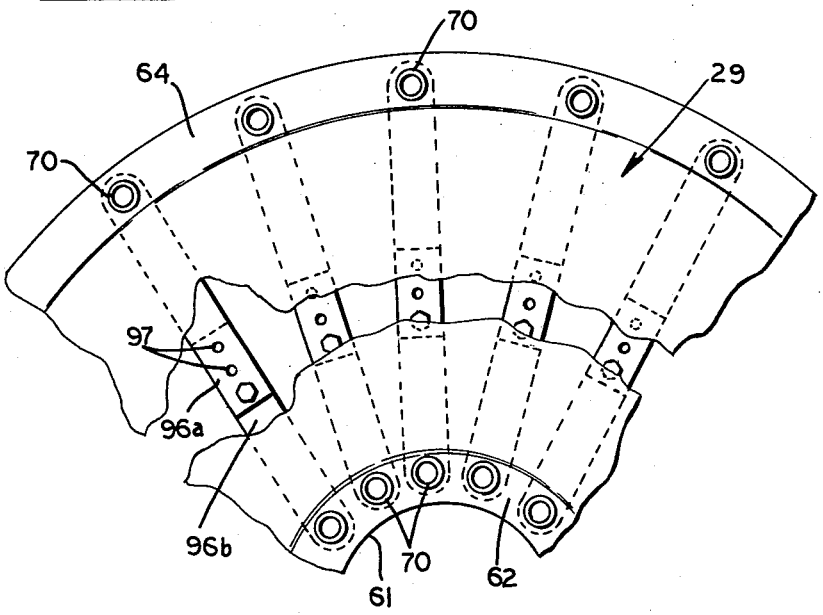
FIG. 8 is a detail end view of the embodiment of FIG. 7, showing the ends of the stays.

As illustrated in FIGS. 7 and 8, a plurality of stays 96 can be included as a part of the insulator blanket. In the embodiment illustrated, metal stays 96 extend radially from the inner peripheral portion of the blanket adjacent central opening 61 to the outer peripheral portion 64, and grommets 70 are attached to and form openings through the end portions of the stays. The stays 96 of FIGS. 7 and 8 are illustrated as being positioned within the blanket; however, the stays can be located externally of the blanket (not shown), as by inserting the stays through loops attached to the surface of the blanket. Preferably, the stays are formed so that they are adjustable in length, by forming the stays in two sections **96*a* and 96*b*, with alignable connector opening 97 formed in their overlying portions, whereby the stays can be lengthened or shortened and bolts inserted through aligned ones of the openings 97. The stays are formed of a length slightly longer than the radial distance between the openings of the inner and outer mounting ring assemblies 26 and 28, so that the stays tend to bow inwardly toward the axial end wall 12 of the dryer cylinder, thus urging the insulator blanket and its seals 86 and 88** toward engagement with the axial end wall.

Figure 9:
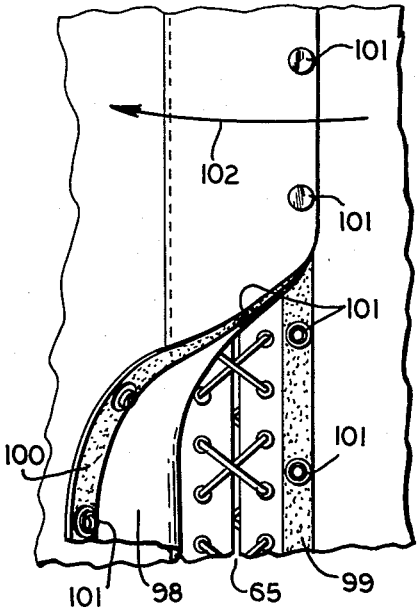
FIG. 9 is a detail end view of the end panel insulator assembly, similar to FIG. 2 but illustrating an embodiment of the invention that includes a flap that covers the grommets and drawstrings of the slot in the insulator blanket.

As illustrated in the embodiment of FIG. 9, the slot 65 can include a closure flap 98 that extends from one side to the other side of the slot and covers the cords 68. Velcro strips 99 and 100 are attached to the edge of flap 98 and adjacent slot 65, and when pressed together, tend to hold the flap in place over the cords. Additionally, snaps 101 are attached to the flap structure to assure that the flap remains closed when the insulator blanket is rotating. Preferably, the insulator blanket is installed so that the direction of rotation is opposite to the orientation of the flap, as indicated by arrow 102, so that the relative wind tends to hold the flap closed.

The flexibility of the insulator blanket permits the blanket to be installed about the axle of the dryer cylinder when the dryer cylinder is in its operational configuration. In the embodiment of FIGS. 1–7, the insulator blanket can be removed from the inner and outer mounting ring assemblies and replaced with another insulator blanket without requiring replacement of the mounting rings. The mounting rings can be attached to the axial end wall of the dryer cylinder without contacting the connector bolts 32 of the dryer cylinder, by attaching the outer mounting ring to the jack screw openings or to other tapped and threaded openings that can be formed in the axial end wall of the dryer cylinder.

Figure 11:
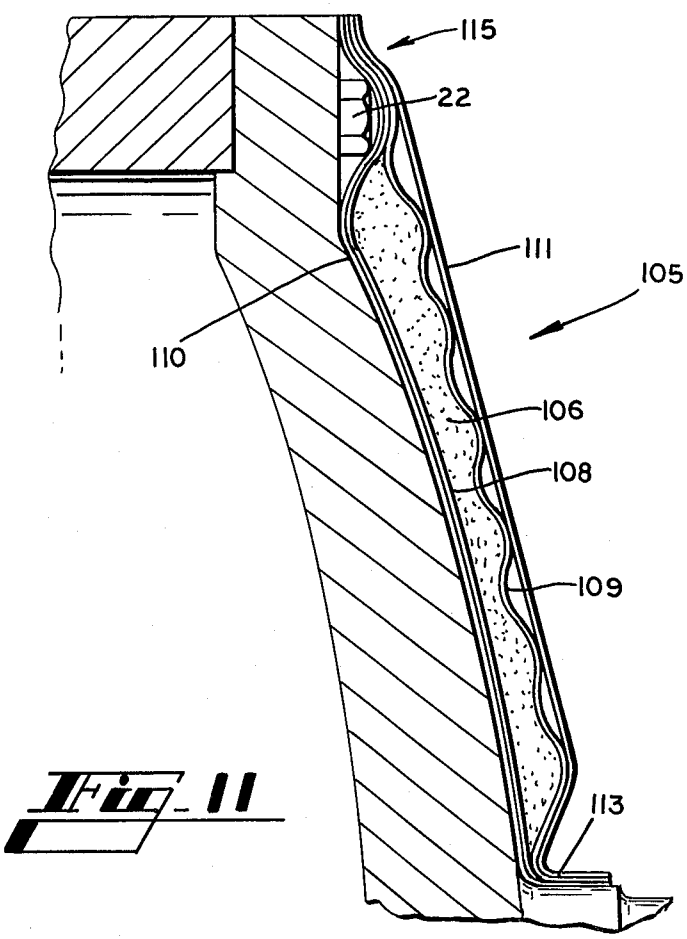
FIG. 11 is a side cross-sectional view of one-half of an end panel insulator assembly, similar to FIGS. 2 and 10, but illustrating an embodiment of the invention in which the insulator blanket is adhesively mounted to the axial end wall of the cylinder without mounting rings.
Figure 10:
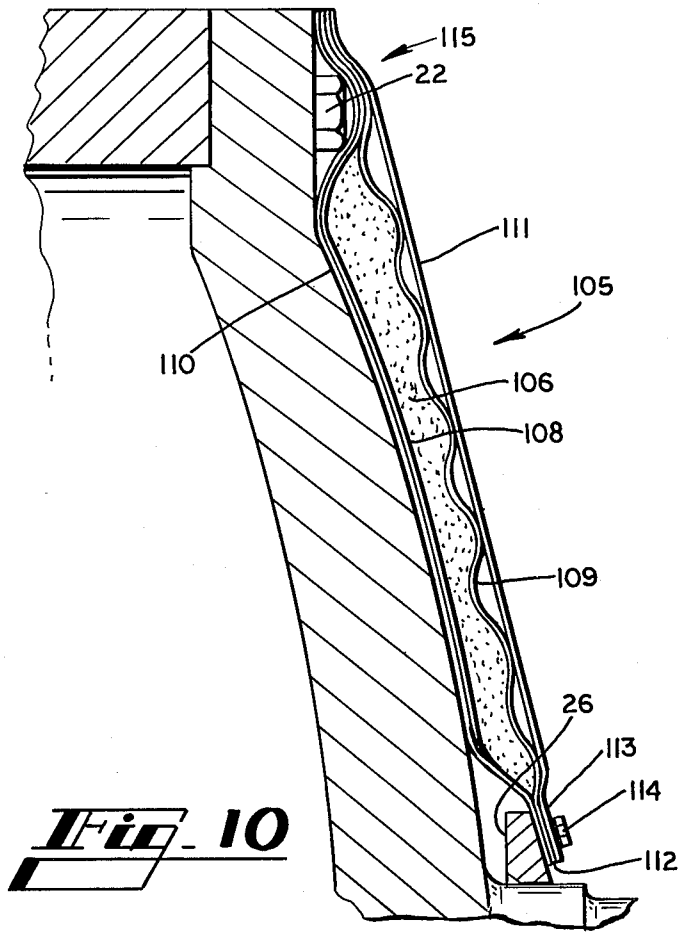
FIG. 10 is a side cross-sectional view of one-half of an end panel insulator assembly, similar to FIG. 2, but illustrating an embodiment of the invention that includes an inner mounting ring but no outer mounting ring, and adhesive connection between the insulator blanket and the outer surface of the axial end wall of the cylinder.

As illustrated in the embodiments of FIGS. 10 and 11, the insulator blanket can be attached directly to the outer surface of the axial end wall with adhesive. In FIG. 10 the insulator blanket 105 includes an inner layer 106 of heat insulation material, inner cover layers 108 and 109 of thin, relatively nonstretchable heat resistant sheet material such as sheets of Nomex, Kevlar, or Viton with the heat insulation material. A durable outer cover is formed by woven Nylon sheets 110 and 111 coated with Neoprene, Teflon sheets, or Hyperlon. The inner peripheral edge portion 113 adjacent central opening 112 is mounted on inner mounting ring 26 with screws 114 extending through grommets of the insulator blanket and into the mounting ring. An adhesive coating is applied to the facing surfaces of the insulator blanket and the outer surface of the axial end wall of the cylinder to hold the insulator blanket to the cylinder. At the outer peripheral edge portion 115 a flap is formed to cover the heads of the connector screws 22, with the flap being secured about the heads of the connector screws to the axial end wall. The adhesive would be, for example, a high or low temperature resistant epoxy glue.

As illustrated in FIG. 11, the insulator blanket 105 is mounted directly to the surface of the axial end wall without the use of either inner or outer mounting rings. The inner peripheral edge portion 113 is applied directly to the axial end wall of the cylinder with the adhesive coating.

While the invention has been described in association with heated dryer cylinders for paper mills, it should be understood that the invention can be used with other temperature controlled cylinders, either heated or cooled. Moreover, it should be understood that the foregoing description relates only to preferred embodiments of the present invention and that numerous modifications or alterations may be made therein without departing from the spirit and scope of the invention as set forth in the appended claims.

We claim:

1. An end panel insulator assembly for mounting to the exterior surface of the axial end wall of a temperature controlled rotary cylinder, said end wall including a series of bolt heads protruding therefrom at its periphery and jack screw openings or other openings in an annular array at positions between said bolt heads, said end panel insulator assembly including an annular mounting ring structure sized and shaped to span the openings of the end wall of a cylinder and defining mounting openings therethrough that are alignable with the openings of the end wall of the cylinder, connector means for connecting said annular mounting ring at its mounting openings to the openings of the axial end wall of the cylinder in spaced relationship with respect to the bolt heads of the cylinder, a flexible insulator panel including a peripheral edge portion which corresponds in size and in shape to said annular mounting ring, and connector means for connecting said insulator panel at its peripheral edge portion to said annular mounting ring structure, whereby the insulator panel is stretched across the exterior surface of the axial end wall of the rotary cylinder and substantially covers the axial end wall and its bolt heads and substantially conforms to the surface profile of the axial end wall.

2. The end panel insulator assembly of claim 1 and wherein said insulator panel comprises a unitary assembly formed of flexible heat insulation material and defines a central opening and a slot extending from said central opening through the peripheral edge portion, whereby the insulator panel can be installed about an axle protruding from an end wall of a cylinder.

3. The end panel insulator assembly of claim 1 and wherein said insulator panel includes layers of flexible heat insulation material and intermediate layers of flexible relatively unstretchable material, and connector threads connecting said heat insulation material to said unstretchable material, whereby the layers of flexible heat insulation material are anchored by the connector threads to the flexible relatively unstretchable material so that when the insulator panel is rotated the radial movement of the insulation material is restrained.

4. The end panel insulator assembly of claim 3 and wherein said connector threads comprise stitching extending through the layers of insulation material and unstretchable material, and with said stitching arranged to form pockets throughout said insulator panel for holding the insulation in place.

5. The end panel insulator assembly of claim 1 and wherein said insulator panel comprises a flexible unitary assembly formed of heat insulation material and defines a central opening and a slot extending radially from said central opening through said peripheral edge portion whereby the insulator panel can be flexed to be installed about an axle protruding from an end wall of the cylinder, and connector means for attachment to the cylinder and for mounting said insulator panel at its central opening to the end wall of the cylinder about the axle of the cylinder, and means for connecting together the adjacent edges of the slot and closing the slot, whereby the insulator panel can be removed from the rotary cylinder and its mounting ring structure and connector means by opening it slot and disconnecting its central opening from the connector means and disconnecting its peripheral edge portion from the annular mounting ring structure and withdrawing the insulator panel from about the axle of the rotary cylinder.

6. The end panel insulator assembly of claim 1 and further including a plurality of stays extending radially from the central portion to the peripheral edge portion of said insulator panel, said stays being bowed toward the end wall of the cylinder to urge the insulator panel toward engagement with the end wall of the cylinder.

7. The end panel insulator assembly of claim 1 and wherein said insulator panel defines a central opening for surrounding an axle protruding from an end wall of a cylinder, and further including at least one annular seal protruding from a side surface of said insulator panel coaxial with and located radially inwardly of said mounting ring structure for contact with the end wall of a cylinder.

8. An end panel insulator assembly for mounting to the exterior surface of the axial end wall of a temperature controlled cylinder of the type rotatable on an axle and used to dry a web passing over the peripheral surface thereof comprising a flexible insulator panel with an approximately circular peripheral edge portion, an central opening and a slot extending from said central opening through said peripheral edge portion whereby the panel can be flexed to open the slot to install the panel about the axle of a cylinder, an inner mounting ring assembly for rigid connection to the central portion of the end wall of a cylinder about the axle thereof and an outer mounting ring assembly for rigid connection to the outer peripheral portion of the end wall of the cylinder, means for releasably connecting the insulator panel to said inner mounting ring assembly and to said outer mounting ring assembly when said inner and outer mounting rings are connected to the end wall of cylinder, whereby the inner and outer mounting ring assemblies are rigidly connected to the axial end wall of a cylinder and the flexible insulator panel is installed about the axle of the dryer cylinder and connected at its central opening and at its peripheral edge portion to the inner and outer mounting ring assemblies.

9. The end panel insulator assembly of claim 8 and wherein said flexible insulator panel comprises at least one layer of heat insulation material and at least one layer of relatively unstretchable material and stitching connecting said layers together, so that when the flexible insulator panel is rotated with its cylinder, radial movement of the heat insulation material is restrained.

10. The end panel insulator assembly of claim 9 and wherein said stitching is arranged to form pockets throughout said flexible insulator panel for holding the heat insulation material in place.

11. The end panel insulator assembly of claim 9 and wherein said at least one layer of relatively unstretchable material comprises wire mesh screen.

12. The end panel insulator assembly of claim 8 and wherein said outer mounting ring assembly comprises a pair of semi-circular ring sections and connector means for attaching said ring sections to the outer peripheral portion of the end wall of a dryer cylinder.

13. The end panel insulator assembly of claim 8 and further including a plurality of stays extending radially from adjacent said central opening to said peripheral edge portion for biasing the flexible insulator panel toward the end wall of the cylinder.

14. The end panel insulator assembly of claim 13 and wherein said stays are each connected at their inner and outer end portions to said inner and outer mounting rings.

15. An end panel insulator assembly for mounting to the exterior surface of the axial end wall of a temperature controlled cylinder of the type rotatable about an axle and used to dry a web passing over the peripheral surface thereof, and wherein the end wall includes a plurality of threaded openings, said end panel insulator assembly including an outer mounting ring sized and shaped to span the threaded openings of the axial end wall of a cylinder, mounting connectors for rigidly connecting said outer mounting ring to the threaded openings of the dryer cylinder, and a flexible insulator panel of unitary construction including a peripheral edge portion for connection to said outer mounting ring, a central opening for installation about the axle of the dryer cylinder, and a slot extending from said central opening through said peripheral portion whereby the insulator panel can be flexed to open its slot to install the panel about the axle of the cylinder, means for closing said slot, and connector means for releasably connecting the peripheral edge portion of the insulator panel to said outer mounting ring when said outer mounting ring is connected to the dryer cylinder.

16. The end panel insulator assembly of claim 15 and further including an inner mounting ring for connection to the axial end wall of the cylinder and connected to said insulator panel at said central opening, said insulator panel comprising layers of heat insulator material and intermediate layers of relatively unstretchable material and stitching arranged in approximately concentric annular patterns and radial patterns about said central opening and connecting said layers of material together so that when the flexible insulator panel is rotated with its cylinder, radial movement of the heat insulator material is restrained.

17. An end panel insulator assembly for mounting to the exterior surface of the axial end wall of a temperature controlled cylinder, the end wall including a centrally located central protrusion from which an axle extends and a peripheral edge portion in a plane offset from the central protrusion and mounted to the dryer cylinder and defining a plurality of threaded openings therein, said end panel insulator assembly comprising an outer mounting ring assembly sized and shaped to span the threaded openings of an end wall of a cylinder, an inner mounting ring assembly sized and shaped to extend about the central protrusion of the end wall of the cylinder, a flexible insulator panel of approximate truncated conical configuration including an outer peripheral portion for connection to said outer mounting ring and a central opening and an inner peripheral portion for connection to said inner mounting ring, and a slot extending from said inner opening through said outer peripheral portion, connector means for releasably connecting the outer peripheral portion of the panel to said outer mounting ring assembly and for releasably connecting the inner peripheral portion of the panel to said inner mounting ring assembly, whereby the insulator panel can be flexed to open its slot to install the panel about the axle of the cylinder and the inner and outer peripheral portions connected to the inner and outer mounting ring assemblies.

18. An end panel insulator assembly for mounting to the exterior surface of the axial end wall of a temperature controlled cylinder, the cylinder including a cylindrical portion and at least one axial end wall attached at its peripheral edge portion by a circular array of bolts to the end of the cylindrical portion and the axial end wall including an axle protruding therefrom, said insulator assembly comprising a frustum-shaped flexible insulator panel of unitary construction defining a central opening for mounting about the axle of the end wall of a cylinder, an outer peripheral edge portion, and a slot extending from said central opening through said outer peripheral edge portion, means for connecting together the edges of the panel at the slot to close said slot, an annular seal extending from said insulator panel for engaging the exterior surface of the axial end wall of a cylinder at a position adjacent and radially inwardly of the circular array of bolts of the end wall of the cylinder, and means for connecting said insulator panel to the exterior surface of the axial end wall of a cylinder, whereby the insulator panel can be flexed to open its slot to install the panel about the axle of a cylinder, the slot closed and the panel connected to the end wall of the cylinder with the annular seal located adjacent the circular array of bolts.

19. The end panel insulator assembly of claim 18, wherein said flexible insulator panel comprises insulation material and means for anchoring the insulation material in said insulator panel at spaced locations throughout the insulator panel.

20. The end panel insulator assembly of claim 18 and further including an access opening formed in said insulator panel and a flap formed of said insulator panel to close said access opening.

21. The end panel insulator assembly of claim 18 and wherein said insulator panel comprises a plurality of overlying layers of heat insulation material and intermediate layers of relatively non-stretchable material, and stitching formed through the layers of material to hold the layers together so that when the insulator panel is rotated with its cylinder, radial movement of the heat insulation material is restrained.

22. The end panel insulator assembly of claim 18 and further including an inner mounting ring for connection to the end wall of a cylinder about the axle and an outer mounting ring for connection to the end wall of a cylinder, and means for connecting the insulator panel at its central opening to said inner mounting ring and for connecting the insulator panel at its outer peripheral edge portion to said outer mounting ring.

23. The end panel insulator assembly of claim 18 and further including a plurality of stays extending radially from adjacent the central opening to the other peripheral edge portion of said insulator panel, said stays biasing the flexible insulator panel toward the end wall of the cylinder.

24. The end panel insulator assembly of claim 18 and wherein said means for connecting said flexible insulator panel to the exterior surface of the axial end wall of a cylinder comprises an inner mounting ring rigidly connected to said cylinder, connector means connecting the inner peripheral portion of said insulator panel to said inner mounting ring, and an adhesive coating applied to the facing surfaces of said insulator panel and the axial end wall of the cylinder and extending from adjacent said inner mounting ring radially outwardly thereof to hold the panel in abutment with the end wall and to conform the shape of the flexible insulator panel to the shape of the axial end wall of the cylinder.

25. An end panel insulator assembly for mounting to the exterior surface of the axial end wall of a temperature controlled rotary cylinder, said end wall including a series of bolt heads protruding therefrom at its periphery and jack screw openings or other openings in an annular array at positions between the bolt heads, the end panel insulator assembly including an annular mounting ring structure sized and shaped to span the openings of the end wall of a cylinder and defining mounting openings therethrough that are alignable with the openings of the end wall of the cylinder, connector means for connecting the inner mounting ring at its mounting openings to the openings of the axial end wall of the cylinder, an insulator panel including a peripheral edge portion which corresponds in size and in shape to said annular mounting ring, connector means for connecting said insulator panel at its peripheral edge portion to said annular mounting ring structure, said insulator panel further including an access opening and a closure normally urged by centrifugal forces from the rotation of the insulator panel with the cylinder toward closed relationship with said access opening.

26. An end panel insulator assembly for mounting to the exterior surface of the axial end wall of a temperature controlled cylinder of the type rotatable on an axle and used to dry a web passing over the peripheral surface thereof comprising a flexible insulator panel with an approximately circular peripheral edge portion, a central opening and slot extending from said central opening through said peripheral edge portion, an inner mounting ring assembly for rigid connection to the central portion of the end wall of a cylinder about the axle thereof and an outer mounting ring assembly for rigid connection to the outer peripheral portion of the end wall of the cylinder, whereby the inner and outer mounting ring assemblies are rigidly connected to the axial end wall of a cylinder and the flexible insulator panel is installed about the axle of the dryer cylinder and connected at its central opening and at its peripheral edge portion to the inner and outer mounting ring assemblies, said insulator panel further comprising an access opening for alignment with the access opening of the axial end wall of the cylinder, and a flap normally urged by centrifugal force due to the rotation of the insulator panel with the cylinder toward closed relationship with the access opening.

27. An end panel insulator assembly for mounting to the exterior surface of the axial end wall of a temperature controlled cylinder of the type rotatable about an axle and used to dry a web passing over the peripheral surface thereof, and wherein the end wall includes a plurality of threaded openings, said end panel insulator assembly including an outer mounting ring sized and shaped to span the threaded openings of the axial end wall of the cylinder, mounting connectors for rigidly connecting said outer mounting ring to the threaded openings of the dryer cylinder, and a flexible insulator panel including a peripheral edge portion connected to said outer mounting ring, a central opening for installation about the axle of the dryer cylinder, and a slot extending from said central opening through said peripheral portion whereby the insulator panel can be flexed to open its slot to install the panel about the axle of the cylinder, means for closing said slot, said outer mounting ring defining a series of openings therein and wherein the peripheral edge portion of said insulator panel comprises a plurality of grommets each defining an opening through said insulator panel, and a plurality of cam connectors each extending through one of said grommets and one of said mounting ring openings, said cam connectors each including means for adjusting the position of its grommet with the position of its mounting ring opening.

* * * * *